US010094527B1

(12) United States Patent
Bushre

(10) Patent No.: US 10,094,527 B1
(45) Date of Patent: Oct. 9, 2018

(54) VEHICLE LOW BEAM HEADLAMP HAVING PARTIALLY TRANSMISSIVE SHUTTER REGION

(71) Applicant: Adam Bushre, Saranac, MI (US)

(72) Inventor: Adam Bushre, Saranac, MI (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/711,664

(22) Filed: Sep. 21, 2017

(51) Int. Cl.

| | |
|---|---|
| ***F21V 5/00*** | (2018.01) |
| ***F21S 41/43*** | (2018.01) |
| ***F21S 8/10*** | (2006.01) |
| ***F21S 41/25*** | (2018.01) |
| ***F21S 41/32*** | (2018.01) |

(52) U.S. Cl.
CPC ..... *F21S 41/43* (2018.01); *F21S 41/25* (2018.01); *F21S 41/321* (2018.01); *F21S 48/125* (2013.01); *F21S 48/1323* (2013.01); *F21S 48/145* (2013.01)

(58) Field of Classification Search
CPC ..... F21S 41/645; F21S 41/135; B62J 6/02
USPC ..... 362/520
See application file for complete search history.

(56) References Cited

U.S. PATENT DOCUMENTS

| | | | | |
|---|---|---|---|---|
| 5,264,993 | A * | 11/1993 | Neumann | F21S 41/323 362/510 |
| 7,244,056 | B2 * | 7/2007 | Koike | F21S 48/145 362/507 |
| 8,070,339 | B2 | 12/2011 | Koike | |
| 8,104,938 | B2 * | 1/2012 | Takada | F21S 41/162 362/509 |
| 8,523,417 | B2 | 9/2013 | Kobayashi | |
| 9,068,710 | B2 | 6/2015 | Lai | |
| 9,108,566 | B2 * | 8/2015 | Simchak | B60Q 1/12 |
| 9,150,144 | B2 | 10/2015 | Abe | |
| 9,396,925 | B1 | 7/2016 | Rice et al. | |
| 2009/0052200 | A1 | 2/2009 | Tessnow et al. | |
| 2013/0107559 | A1 * | 5/2013 | Gava | F21S 41/645 362/516 |

OTHER PUBLICATIONS

Excerpt from Wördenweber, et al., "Automotive Lighting and Human Vision", ISBN 978-3-540-36696-6 (Springer Berlin, Heidelberg, New York, 2007) at Chap. 31, pp. 102-108 (9 pages).

(Continued)

*Primary Examiner* — Seung Lee
(74) *Attorney, Agent, or Firm* — Edward S. Podszus

(57) ABSTRACT

A projection headlamp (12) has a reflector (28) reflecting light emitted from a light engine (20); a projector lens (30) projecting reflected light from the reflector (28); and a shutter (22) disposed between light engine (20) and projector lens (30), the shutter (22) having an upper edge (44) defining a cut-off to generate a low beam pattern by obscuring a portion of the projector lens (30) from the reflected light and to selectively emit the reflected light through the projector lens (30) in a low-beam light distribution pattern. The shutter (22) further includes a partially light-transmissive shutter bump (56) extending above the upper edge (44) which attenuates light emitted from the projector lens (30) in a predefined area of the low-beam pattern. Light intensity at the 0.86D, 3.5L NHTSA test point (112) is attenuated to below maximum photometric intensity (12,000 candela), avoiding glare.

14 Claims, 10 Drawing Sheets

(56) References Cited

OTHER PUBLICATIONS

"Headlight Test and Rating Protocol" (Version I), Insurance Institute for Highway Safety (Ruckersville, VA Feb. 2016), pp. 1-10 incl. App. A-1 and App. B-1, B-2 (14 pages, color).
"Federal Motor Vehicle Safety Standards; Lamps, Reflective Devices, and Associated Equipment; Final Rule", 49 CFR Parts 564 and 571 in Federal Register, vol. 72, No. 232, Dec. 4, 2007, pp. 68234-68439, with Table XIX-a appearing on p. 68329 (p. 97 of document, consisting of 207 pgs).

* cited by examiner

22

VEHICLE LOW BEAM HEADLAMP HAVING PARTIALLY TRANSMISSIVE SHUTTER REGION

STATEMENT REGARDING FEDERALLY SPONSORED RESEARCH OR DEVELOPMENT

N/A

TECHNICAL FIELD

The present application relates to automotive headlamps and more particularly to headlamps having improved low beam performance, more particularly those of the PES (Projector Ellipsoid System) type.

BACKGROUND

Lighting systems (such as headlights) are well-known and are used in a wide variety of applications, including automotive applications. In general, a lighting system includes one or more projector apparatus for emitting one or more distinct light patterns. For example, a lighting system may emit light in a low-beam pattern/mode in which light is generally emitted below the horizon. The lighting system may also emit light in a high beam pattern/mode in which light is generally emitted above and below the horizon.

Recent developments in headlamp performance ratings/testing procedures have changed the photometric output requirements, making it more difficult for manufactures to comply. Non-exhaustive examples of some potentially applicable regulations/testing procedures for glare in incoming traffic are described by United States National Highway Traffic Safety Administration (NHTSA) (e.g., at pages 96-99 and Table XIX-a of the Department of Transportation (DOT) 49 C.F.R. Parts 564 and 571 (which correspond to Vol. 72, No. 232 (Dec. 4, 2009) pages 68328-68331 of the Federal Register), hereinafter referred to as the NHTSA standard) as well as the Insurance Institute for Highway Safety (IIHS)™ Headlight Test and Rating Protocol (Version I) (February 2016). In general, the new requirements and/or testing procedures specify sharper gradient cutoffs, wider spreads, and reduced glare to oncoming traffic.

One way to produce a sharp gradient cutoff is through the use of a "projector" design headlamp. Projector headlamp designs involve light passing by a shutter (also referred to as a shade or shield) that blocks or subtracts light out of the pattern to produce a sharp gradient cutoff before passing the light to a projector lens. A shutter generates a low beam pattern. Some shutters are fixed (e.g., non-movable). Other shutters are movable and toggle between two positions that change the pattern from low beam to high beam by removing the blocking effect of the shutter. Examples of shutters in projector headlamps are seen in Pat. Pub. US 2009/0052200 (Tessnow) and U.S. Pat. No. 8,070,339 (Koike) at FIG. 7 therein described as prior art. Examples of other headlamps are shown in U.S. Pat. No. 9,150,144 (Abe); U.S. Pat. No. 9,068,710 (Lai); and U.S. Pat. No. 8,523,417 (Kobayashi).

A problem associated with the known shutter designs is that they can only block the light in specified areas; however, the known shutter designs cannot reduce the light in specified areas while still allowing some light to illuminate the area, because they are made of sheet metal (and are also heavy) in order to withstand the heat of a halogen or HID light source, as described for example in the treatise handbook *Automotive Lighting and Human Vision*, at Chapter 3.1, p. 107, Table 3.2 (Woerdenweber et al., Springer Verlag, Corp. 2007) (hereinafter "Automotive Lighting and Human Vision"). Put another way, the known shutter designs are an "all-or-nothing" design meaning they either allow all the available light to illuminate a specific area, or allow none of the available light to illuminate the specific area.

BRIEF DESCRIPTION OF THE DRAWINGS

Reference should be made to the following detailed description which should be read in conjunction with the following figures, wherein like numerals represent like parts.

DETAILED DESCRIPTION INCLUDING BEST MODE OF A PREFERRED EMBODIMENT

In general, one embodiment of the present disclosure features a projector apparatus. The projector apparatus may be useful as an automotive headlight, tail light, and/or signal light, a marine light, an aircraft light, a recreational vehicle light, or other application for which two or more light distribution patterns are desired. The projector apparatus includes a reflector configured to reflect visible light emitted from a primary light engine, a projector lens configured to project at least a portion of the reflected visible light from the reflector, and a shutter disposed between the primary light engine and the projector lens. The shutter can be fixed (e.g., non-movable) or movable (e.g., movable between a first and at least a second position). The shutter defines an upper edge, which defines a cut-off edge in the projected beam, configured to selectively obscure a portion of the projector lens from the reflected visible light and is configured to selectively emit at least a portion of the reflected visible light through at least a portion of the projector lens in a first light distribution pattern when disposed in the first position. The shutter further includes a shutter bump configured to attenuate an amount of visible light emitted from the projector lens in a predefined area of the first light distribution pattern. For example, a shutter consistent with the present disclosure allows a projector apparatus to emit a low beam light pattern in which the luminosity of one or more regions below the horizontal axis can be adjusted, for example, by selectively reducing the amount of light in a specified point and/or area while still allowing some light to illuminate the area. As such, a shutter consistent with the present disclosure may be configured to allow a designer to set a desired maximum luminosity of a specific area that is less than the maximum possible luminosity for a given projector apparatus, therefore solving the problems associated with traditional shutter designs.

Figure 1:
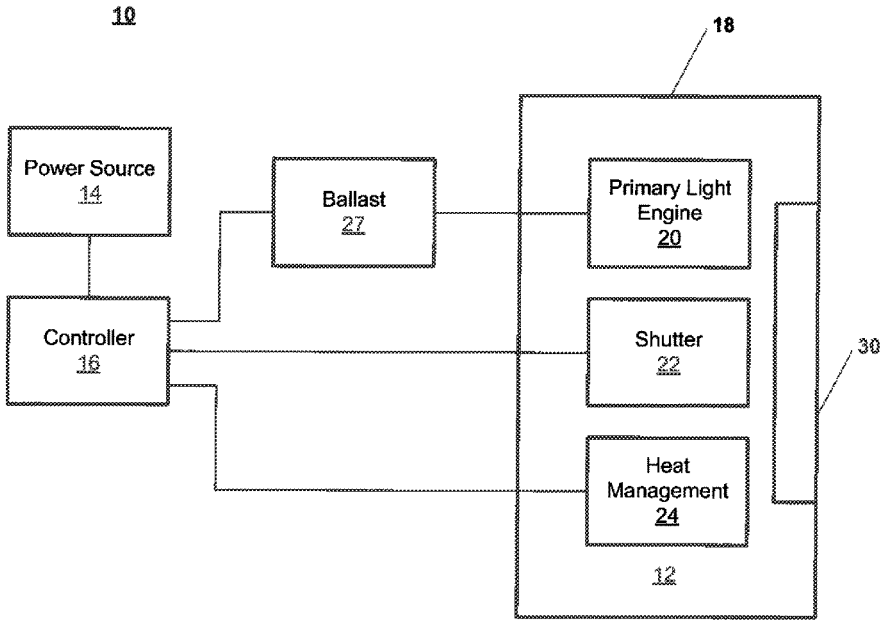
FIG. 1 diagrammatically illustrates a lighting system consistent with at least one embodiment of the present disclosure.

Turning now to FIG. 1, one embodiment of a lighting system 10 consistent with the present disclosure is generally illustrated. The lighting system 10 may comprise at least one projector apparatus 12, a power source 14, and a controller 16. The projector apparatus 12 may comprise a housing 18, a primary light engine 20, a shutter 22, and optionally heat management 24. The housing 18 may be configured to receive at least a portion of the primary light engine 20 and/or the shutter 22. The housing 18 may also include one or more lenses 30, such as reflector and/or projector lens as discussed herein. Shutter 22 is also referred to in the art as a shade or shield.

The projector apparatus 12 may receive an electrical input from the power source 14, for example, to energize the primary light engine 20 and/or the shutter 22. The power source 14 may comprise a DC and/or AC power source, and may optionally include one or more inverters, converters, and/or power conditioners. Optionally, one or more ballast circuits 27 may receive an electrical input from the power source 14 and convert it to a stable output for driving the projector apparatus 12. One or more of the ballast circuits 27 may be positioned remotely from the projector apparatus 12 or may be integral with or coupled directly to the housing 18 of the projector apparatus 12.

The controller 16 may transmit one or more signals to control the operation of the lighting system 10. For example, the controller 16 may transmit a signal to the power source 14 in order to selectively energize the primary light engine 20. The controller 16 may also transmit a signal to the shutter 22 to selectively control the position of the shutter 22 as discussed herein.

Figure 2:
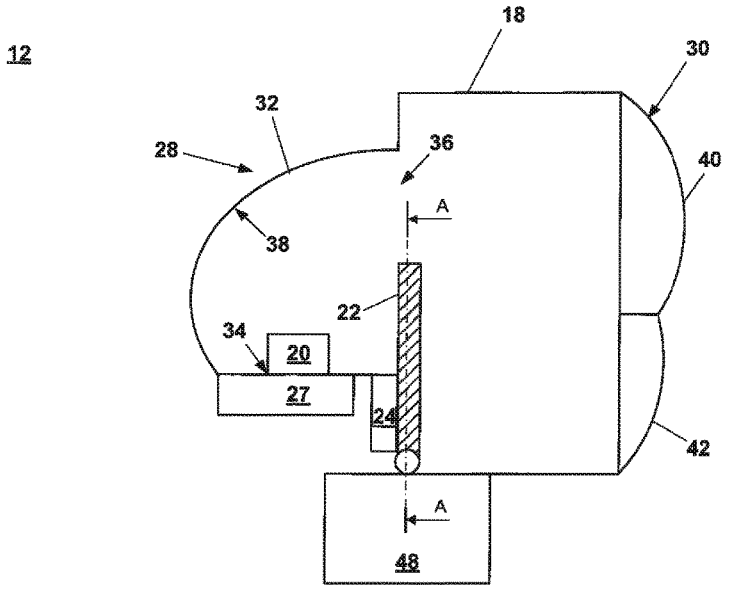
FIG. 2 is a side cross-sectional view diagrammatically illustrating an embodiment of the projector apparatus of FIG. 1.
Figure 3:
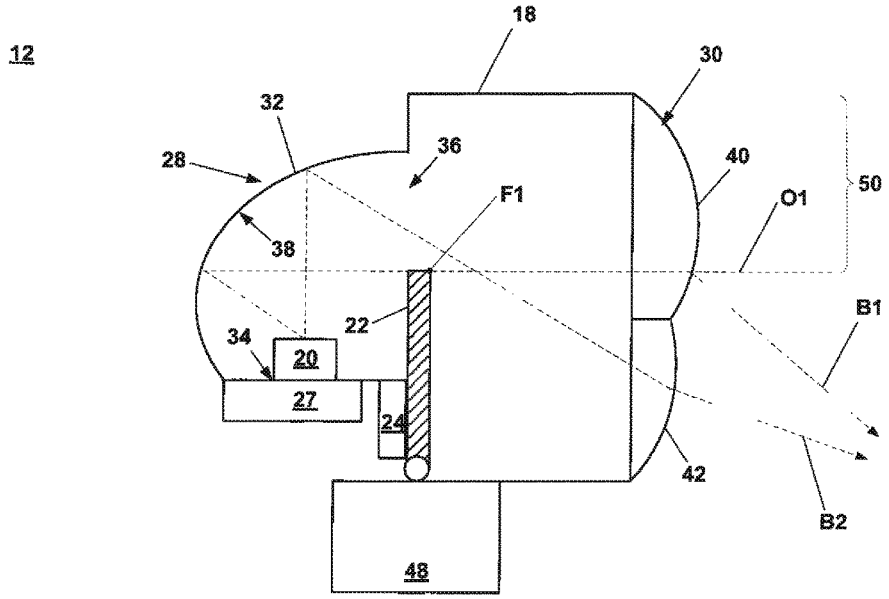
FIG. 3 is another side cross-sectional view diagrammatically illustrating an embodiment of the projector apparatus of FIG. 2 in a low beam mode.
Figure 4:
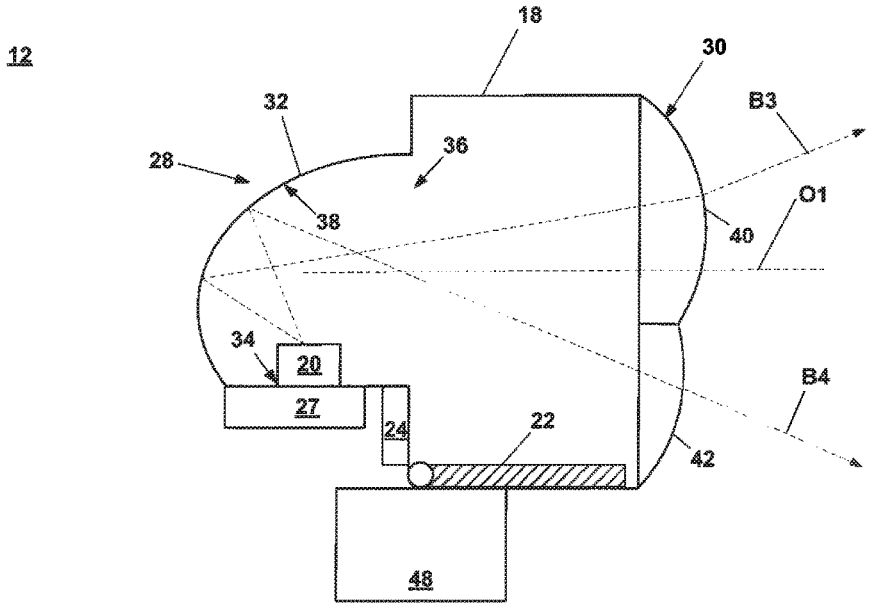
FIG. 4 is another side cross-sectional view diagrammatically illustrating an embodiment of the projector apparatus of FIG. 2 in a high beam mode.

Turning now to FIGS. 2-4, a cross-sectional view of one embodiment of the projector apparatus 12 is generally illustrated. As can be seen, the projector apparatus 12 may comprise the primary light engine 20, at least one reflector 28, at least one projector lens 30, and the shutter 22 which is moveable between at least a first position (as generally illustrated in FIGS. 2 and 3) and a second position (as generally illustrated in FIG. 4).

With reference to FIG. 2, the reflector 28 may be configured to receive light in the visible spectrum generated from the primary light engine 20. For example, the reflector 28 may include a reflector cup 32 including an mounting surface 34 configured to be secured to the primary light engine 20; an open end 36 from which light emitted by the primary light engine 20 may be cast from the projector apparatus 12; and an interior surface 38 configured to reflect light from the primary light engine 20 toward the open end 36. The phrase "reflector cup" thus includes, but is not limited to known parabolic, elliptical, poly-ellipsoidal ("PES") and sphero-elliptical reflector configurations including those with faceted interior surfaces as well as truncated reflector cups. The phrase "truncated reflector cup" means a portion of a reflector cup, as may be realized, for example, by dividing a reflector cup along a plane intersecting the longitudinal axis (e.g., intersecting a first end and a second end). A truncated reflector cup may thus be configured as one-half of a reflector cup, but may be more or less than half of a reflector cup. For example, a truncated reflector cup may have a semi-parabaloid or semi-elipsoid shape.

The projector lens 30 may be configured to emit light, generated from the primary light engine 20, in one or more distribution patterns. For example, the projector lens 30 may be configured to distribute light in a first distribution pattern (e.g., FIG. 3) in which the light is emitted from the projection apparatus 10 substantially at and/or below the horizon. The projector lens 30 may also be configured to distribute light in a second distribution pattern (e.g., FIG. 4) in which the light is emitted from the projection apparatus 10 above and below the horizon.

Figure 5:
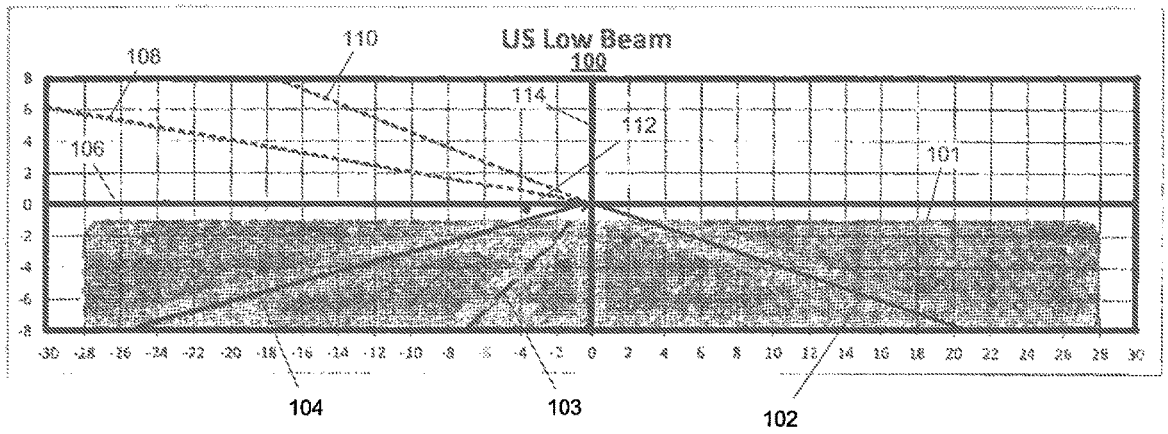
FIG. 5 illustrates a standard United States low beam light distribution.

The phrases "at and/or below the horizon" and "above and below the horizon" are defined with reference to FIG. 5 which illustrates a standard United States beam distribution 100 including a low beam light spread 101 and the following reference lines: road right edge 102; road center line 103; road left edge 104; horizon axis/line 106; on-coming driver's eye position in a car of standard height 108; on-coming driver's eye position in a truck or SUV of taller height 110; and vertical axis/line 114. In particular, the phrase "at and/or below the horizon" means light emitted from the projector lens 30 that is emitted at and/or below the horizontal line 106 (e.g., generally parallel to ground and/or downwardly from the projector apparatus 10 and towards the ground) while the phrase "above and below the horizon" means the light emitted from the projector lens 30 is emitted above and below the horizontal line 106.

Turning back to FIG. 2, lens 30 can be made of a plastics material such as PMMA. Lens 30 is a projector lens, having a light incident surface (facing light source 20) and an oppositely facing light exit surface which is convex, e.g. spherical. From the use of a projector lens 30 and ellipsoidal reflector 28 this type of headlamp 12 is conventionally referred to as a PES (Projector Ellipsoidal System), with which present embodiments of shutter 22 are used.

For example, the projector lens 30 may comprise an aspheric or aspherical lens. According to one embodiment, the projector lens 30 may include an upper partial projector lens 40 and a lower partial projector lens 42. The upper and/or lower partial projector lenses 40, 42 may include, but is not limited to, known parabolic, elliptical and sphero-elliptical configurations, conic sections (such as, but not limited to, paraboloids, hyperboloids, and ellipsoids) as well as higher-order aspherics. Higher-order aspherics mean surface departures from conic, which are proportional to $r^4$, $r^6$, $r^8$, $r^{10}$, and so on, where r is the radial distance from the optical axis.

Referring now to FIG. 3, the upper partial projector lens 40 may include a portion of an aspheric lens that having an optical axis O1 with its focus F1 on the upper edge 44 of the shutter 22. While not labelled for clarity, the lower partial projector lens 42 may also include a portion of an aspheric lens having an optical axis with its focus below the center of the primary light engine 20. The axis of the lower partial projector lens may be the cut plane for both the upper and lower partial projector lenses 40, 42. Both the upper and lower partial projector lenses 40, 42 may have the same focal lengths. Of course, this is merely one exemplary embodiment of the projector lens 30, and other configurations are within the scope of the present disclosure.

The specific arrangement, shape and contour of the reflector 28 and the projector 30 will depend on the specific application of the projector apparatus 12 and may include (but is not limited to) such factors as the overall size constraints on the projector apparatus 12, desired aesthetic appearance of the projector apparatus 12, as well as the desired light output of the projector apparatus 12. Projector lens 30 could also be a simple (rather than compound as in FIGS. 3-4) aspheric lens as known in Tessnow Pub. US 2009/0052200, incorporated by reference as if fully set forth herein, such that when a shutter 22 is in position between light engine 20 and lens 30, shutter 22 cuts off the upper portion of the visible beam creating a sharp cutoff and the low beam mode.

The shutter 22 includes an upper edge 44 that defines a cut-off edge. The upper edge 44 is located, as seen in the path of the light, near the focus of projector lens 30. The shutter 22 may be fixed. Alternatively, shutter 22 may be provided to selectively change the distribution pattern emitted by the projector apparatus 12. In either case, the upper edge 44 of the shutter 22 is used (either alone or in combination with the projector 30) to emit light at and/or below the horizon 106.

In an embodiment in which the shutter 22 is configured to selectively change the distribution pattern emitted by the projector apparatus 12, the shutter 22 may be configured to move between at least a first position (as generally illustrated in FIGS. 2 and 3) and a second position (as generally illustrated in FIG. 4). While the shutter 22 is shown in two different positions (FIGS. 3 and 4), it should be appreciated that the shutter 22 may also be configured to be positioned in other orientations (such as, but not limited to, any position intermediate the first and second positions).

The shutters 22 may be coupled to one or more actuator mechanisms 48. For the sake clarity, only a single shutter 22 and actuator mechanism 48 is shown; however, more than one shutter 22 and/or actuator mechanism 48 may be provided depending on the application. The actuator mechanism 48 may include any device for moving the shutter 22 between the first and second positions. For example, the actuator mechanism 48 may comprise a solenoid and/or motor coupled to the shutter 22 through associated gearing, levers, cams, linkages, pivot arms, or the like, for moving, rotating, and/or pivoting the shutter 22. The actuator mechanism 48 may move the shutter 22 upon receipt of a signal from the controller 16 (FIG. 1) as discussed herein. Alternatively, a user may directly control the actuator mechanism 48 to move the shutter 22. The shutter 22 may, for example, pivot about a pivot axis PA.

The primary light engine 20 may include any known light source configuration such as one or more incandescent light sources (such as, but not limited to, a halogen lamp), solid-state light (SSL) sources including, but not limited to, light emitting diodes (LEDs), organic light-emitting diodes (OLED), and/or polymer light-emitting diodes (PLED), with or without a remote phosphor element, gas discharge light sources such as a fluorescent tube (e.g., in a compact fluorescent (CFL) lamp), and/or a high-intensity discharge (HID) light sources. While the primary light engine 20 is illustrated as a single light source, the primary light engine 20 may include multiple light sources depending on the application. As used herein, the phrase "primary light engine" is intended to mean a light source which provides the primary or main source of illumination. In contrast, the term "secondary light engine" as used herein is intended to mean a light source which primarily functions to increase the visibility of an object (such as, but not limited to, automobiles, aircraft, marine vessels, as well as other vehicles) to others, particularly during daylight. While not shown, the projector apparatus 12 may include one or more secondary light engines in addition to the primary light engines 20. Conventionally, use of a halogen or HID lamp as a light engine required a metal shutter, such as made of stamped sheet metal which could withstand the high filament operating temperatures, so the entire shutter had to be opaque. An advantage of a solid-state light source 20, e.g. an LED, is that the lower operating temperature permits the use of a shutter 22 made of a plastics material; this in turn allows use of differential light transmissive regions in shutter 22, as explained below.

Turning now to FIG. 3, one embodiment of the projector apparatus 12 is illustrated in the low (e.g., regular) beam pattern/mode. In particular, the controller 16 (FIG. 1) may transmit one or more signals configured to energize the primary light engine 20 and emit light (e.g., illustrated schematically as light beams B1 and B2). For example, the controller 16 may transmit a signal to cause the power source 14 (also shown in FIG. 1) to provide the necessary electrical input to the primary light engine 20. The controller 16 may also transmit one or more signals to the shutter 22 to arrange the shutter 22 in a first position. As used herein, the phrase "first position" is intended to mean that at least a portion of the shutter 22 obscures a portion of the projector lens 30 from the light beams B1, B2 emitted from the primary light engine 20.

As discussed in more detail herein, the shutter 22 may be configured to obscure the projector lens 30 from the light beams B1, B2 emitted from the primary light engine 20 when in the first position such that the light emitted projector apparatus 12 is distributed at and/or below the horizon. According to one embodiment consistent with the present disclosure, the shutter 22 may be configured to obscure at least a portion 50 of the upper partial projector lens 40 from the primary light source 20 when arranged in the first position. Optionally, the reflector 28 may also be configured to ensure that the light beams B1, B2 emitted from the primary light engine 20, and reflected therefrom, are obscured from the portion 50 of the projector lens 30 when the shutter 22 is in the first position.

Turning now to FIG. 4, the projector apparatus 12 is illustrated in an optional high beam pattern/mode. In particular, the controller 16 (FIG. 1) may transmit one or more signals configured to energize the primary light engine 20 and may transmit one or more signals to the shutter 22 to arrange the shutter 22 in a second position such that the projector apparatus 12 emits light from the projector lens 30 (e.g., illustrated schematically as light beams B3 and B4) both above and below the horizontal axis. For example, the controller 16 may transmit a signal to cause the power source 14 (also shown in FIG. 1) to provide the necessary electrical input to the primary light engine 20. As used herein, the phrase "second position" is intended to mean that the light (e.g., B3, B4) emitted from the primary light engine 20 may exit the projector lens 30 generally unobstructed by the shutter 22. For example, the light (e.g., B3, B4) emitted from the primary light engine 20 may exit both the upper and lower partial portions 40, 42 of the projector lens 30 when the shutter 22 is in the second position such that the light emitted projector apparatus 12 is distributed at and/or below the horizon. Thus, the shutter 22 generally does not obscure the projector lens 30 from the light beams B3, B4 emitted from the primary light engine 20. Again, it is worth noting that the shutter 22 may be arranged in other positions to define other light patterns. As such, the projector apparatus 12 is not limited to only the first and second positions and/or the low and high beam patterns.

As discussed herein, headlamp performance ratings from the IIHS and NHTSA have changed the photometric output requirements, making it more difficult for manufactures to comply. The new requirements specify sharper gradient cutoffs, wider spreads, and reduced glare to oncoming traffic. For example, with reference to FIG. 5, Table XIX-a of the NHSTA standard mandates, inter alia, a maximum light intensity of 12,000 candela for a test point 112 corresponding to 0.86 degrees down from the horizontal axis and 3.5 degrees left from the vertical axis (also referred to as the (0.86 D, 3.5L) test point 112 or the NHSTA test point 112). The (0.86 D, 3.5L) test point 112 is positioned in the low beam illumination region (e.g., below the horizon 106) and generally corresponds to the amount of glare experienced by incoming traffic. To perform well in both the IIHS and NHTSA rating systems, the (0.86 D, 3.5L) test point 112 should be as close as possible to the maximum limit specified by the NHTSA rules (e.g., 12,000 candela), while not exceeding the maximum photometric intensity. While the known shutter designs can block the light in specified areas, the known shutter designs cannot reduce the light in specified areas while still allowing some light to illuminate the area (e.g., the known shutter designs are an "all-or-nothing" design meaning they either allow all the available light to illuminate a specific area, or allow none of the available light to illuminate the specific area). For example, the known shutter designs cannot attenuate the light in a region corresponding to the (0.86 D, 3.5L) test point 112.

Figure 6:
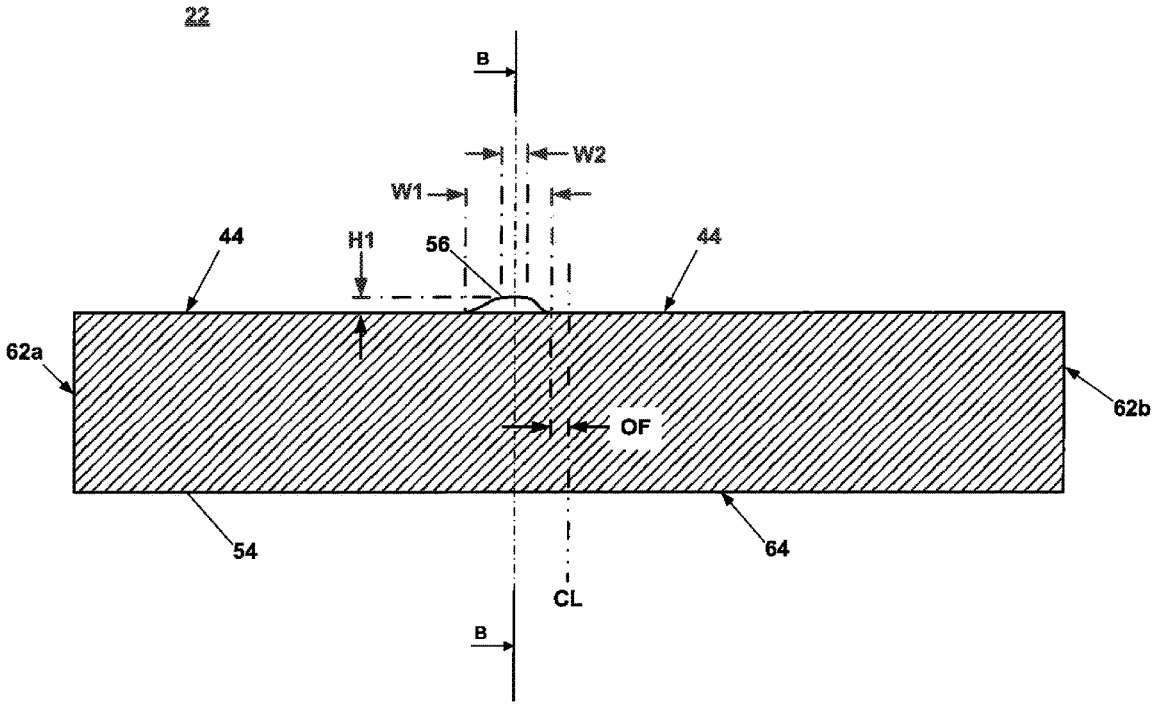
FIG. 6 is a cross-sectional view diagrammatically illustrating an embodiment of the shutter of FIG. 2 taken along lines A-A.
Figure 7:
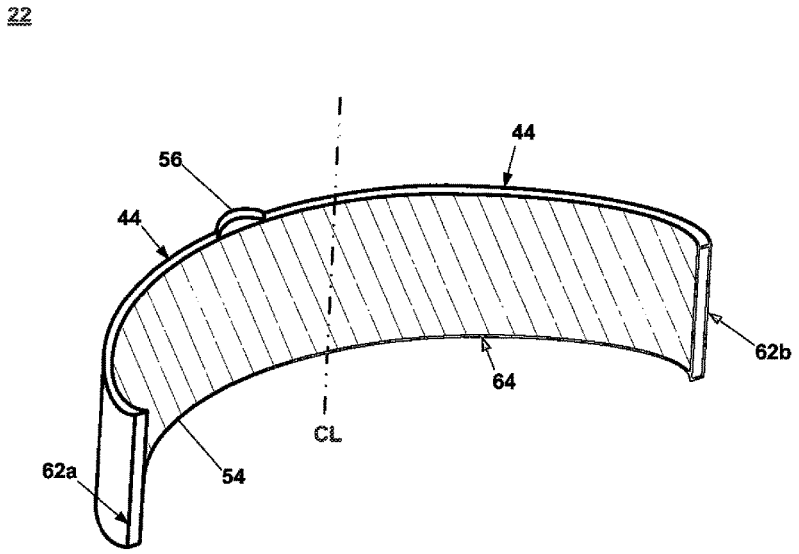
FIG. 7 is a perspective view illustrating an embodiment of the shutter having a generally arcuate profile.

Turning now to FIG. 6, one embodiment of the shutter 22 consistent with the present disclosure is generally illustrated taken along lines A-A of FIG. 2. The overall shape of the shutter 22 will depend on the intended application. For example, in some applications the shutter 22 has a shape that at least partially corresponds to the shape of the reflector 28 or the housing 18 (e.g., but not limited to a generally arcuate shape as generally illustrated in FIG. 7) such that the shutter 22 does not obstruct any of the light emitted by the primary light engine 20 when in the high beam mode.

As explained herein, a shutter 22 consistent with the present disclosure allows a projector apparatus 12 to emit a low beam light pattern in which the luminosity of one or more regions below the horizontal axis 106 (FIG. 5) can be adjusted, for example, by selectively reducing the amount of light in a specified point and/or area while still allowing some light to illuminate the area. As such, a shutter 22 consistent with the present disclosure may be configured to allow a designer to set a desired maximum luminosity of a specific area that is less than the maximum possible luminosity for a given projector apparatus 12, and thereby also remain within regulatory maximum permitted photometric intensity, therefore solving the problems associated with traditional shutter designs.

Figure 8:
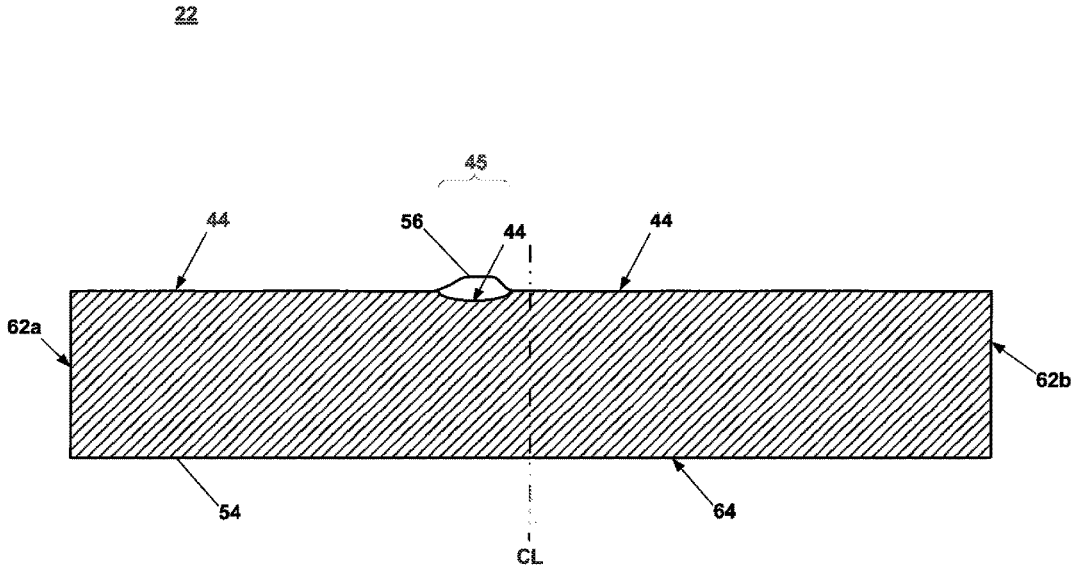
FIG. 8 is a cross-sectional view diagrammatically illustrating another embodiment of the shutter of FIG. 2 taken along lines A-A.

The shutter 22 may include a non-transparent region 54 and one or more shutter bumps 56. The non-transparent region 54 is configured to generally prevent light from being emitted above the horizontal axis and is configured to generally allow light to only be emitted at and/or below the horizontal axis. For example, the non-transparent region 54 defines an upper edge 44 which extends between generally oppositely disposed lateral edges 62*a*, 62*b* of the shutter 22 and generally opposite to a bottom edge 64 of the shutter 22. The upper edge 44 may include one or more generally planar surfaces and/or edges as generally illustrated in FIG. 6; however, the upper edge 44 may include one or more portions (e.g. but not limited to, portion 45) having a non-planar surface and/or edge as generally illustrated in FIG. 8, as is known, for example, in the technical literature "Automotive Lighting and Human Vision" at page 104, FIG. 3.10. In either case, the upper edge 44 defines one or more cut-offs in the projected beam pattern (e.g., the U.S. low beam pattern 500 as generally illustrated in FIG. 5) above which substantially no light is emitted. Non-transparent region 54 is opaque. An example of non-transparent region 54 being opaque is that it may be reflective with respect to light in the visible light spectrum. In a preferred embodiment, upper edge 44 is flat and straight across the upper region of shutter 22 except where bump 56 extends upward therefrom (e.g., as generally illustrated in FIG. 8), though this is not a limitation of the present disclosure unless specifically claimed as such.

The shutter bump 56 is configured to attenuate the luminosity of the visible light emitted in a specific point and/or area below the horizontal cutoff 106 generated in the projected light beam as defined by the upper edge 44, while also allowing some of the light to pass through the shutter bump 56 and to illuminate the specific point and/or area. As used herein, the term "attenuate" means to reduce, but not eliminate. By adjusting the transparency or translucency of the partially light-transmissive shutter bump 56, the amount of light emitted through the shutter bump 56 to illuminate the specific point and/or area below the horizontal axis 106 can be adjusted/selected by the designer (e.g., to be as close as possible to a specified luminosity limit and/or design criteria) without affecting the luminosity of other areas below the horizon 106. It should also be appreciated that the degree of transparency or translucency of the shutter bump 56 may be either constant throughout the entire shutter bump 56 or may vary throughout the shutter bump 56. For example, the degree of transparency or translucency of the shutter bump 56 may include a gradient such that the amount of light that is attenuated by the shutter bump 56 varies as a function its position. This may be particularly useful in applications where it is desirable to attenuate the amount of light in different areas.

It is understood that a material that is transparent or translucent is light-transmissive. The degree of transparency or translucency, size, shape, and location of shutter bump 56 on shutter 22 may be selected based on the size, shape, and location of the specific area below the horizontal axis 106 that the luminosity is to be reduced, as well as the luminosity of primary light source 20, design of reflector 28 and/or projector lens 30, and/or the target luminosity for the specific area. For example, shutter bump 56 may have a light transmittance (to the light wavelength of interest) greater than 0% and less than 90%, for example, between 30% and 80%, including all values and ranges therein. According to one embodiment, shutter bump 56 may have a transmittance greater than 30% and less than 60%, for example, between 40% and 50%, including all values and ranges therein. In a preferred embodiment, the region of shutter bump 56 has a transmittance of 50%. In other embodiments, shutter bump 56 has a transmittance of between 30% and not more than 50%. The partially transmissive region can be formed from a variety of plastics such as optical grade polycarbonate or acrylic (PMMA). Of course, these are merely illustrative examples, and the present disclosure should not be limited to these ranges unless specifically claimed as such. An optics designer using routing skill understands to choose the transmittance dependent on the amount of incident light and the target to be projected into the beam pattern at a location corresponding to shutter bump 56.

The size and shape of the shutter bump 56 will depend on the position of the projector apparatus 12 when installed in the vehicle, as well as range of angles between the projector apparatus 12 and measuring sensors used in the testing procedure. Non-exhaustive examples of some of the potentially applicable regulations for glare in incoming traffic are described at pages 96-99 and Table XIX-a of the Department of Transportation (DOT) 49 C.F.R. Parts 564 and 571 (which correspond to Vol. 27, No. 232 (Dec. 4, 2009) pages 68328-68331 of the Federal Register) as well as the IIHS Headlight Test and Rating Protocol (Version I) (February 2016). Of course, it should be appreciated that other rules, regulations, and/or testing procedures (both within the United States and outside of the United States) may also be used when determining the location, size, shape, and attenuation of the shutter bump 56. In addition, the amount of attenuation of the light emitted through the shutter bump 56 will depend on the maximum amount of light that the projector apparatus 12 is capable of emitting in the specified point and/or area.

In the illustrated embodiment, a single shutter bump 56 is illustrated having a center which is positioned to correspond to a test point in the headlamp's projected beam pattern located at 0.86 degrees down from the horizontal axis 106 and 3.5 degrees left from the central, vertical axis 114, e.g., as generally prescribed in the NHSTA regulations, i.e., the (0.86D, 3.5L) test point 112 as generally described above in combination with FIG. 5. For exemplary purposes only, the shutter bump 56 (FIG. 6) may have a height H1 of 1.10 mm, an offset OF of 1.22 mm from the optical center CL, a width W1 at the base of the shutter bump 56 of 6.14 mm, and a width W2 at the top of the shutter bump 56 of 1.85 mm. The shutter bump 56 preferably has a 50% transmittance and the non-transparent region 54 is 65% reflective. Such a configuration has been simulated to reduce the maximum luminosity of this point/area from an amount exceeding the regulatory maximum limit of 12,000 candela to be at or slightly below the maximum limit of 12,000 candela when using a 1×5 LED having a light input intensity of 2,000 lumens. As used herein, the term "slightly below" is intended to mean within 10% of the maximum limit as specified by the NHSTA regulations. It should be appreciated that the shutter 22 is not limited to the configuration of the shutter bump 56 shown in FIG. 6 unless specifically claimed as such, and that one or more shutter bumps 56 may be positioned anywhere on the shutter 22 (for example, above and/or below the upper edge 44).

Figure 9:
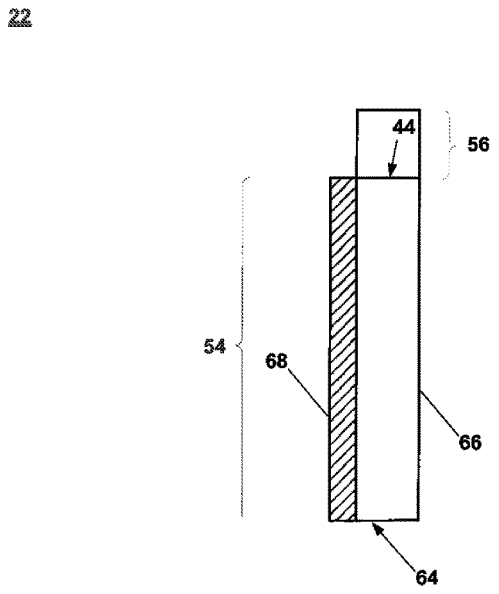
FIG. 9 is a cross-sectional view diagrammatically illustrating one embodiment of the shutter of FIG. 6 taken along lines B-B.

The shutter 22 may be formed by injection molding, extrusion, thermoforming, or the like. The non-transparent region(s) 54 and shutter bumps 56 of the shutter 22 may be formed in a variety of ways. For example, a cross-sectional view of one embodiment of the shutter 22 of FIG. 6 taken along lines B-B is generally illustrated in FIG. 9. According to this embodiment, the shutter 22 includes at least one light-transmissive layer 66 and at least one non-transparent layer 68. The light-transmissive layer 66 may be semi-transparent or translucent. The light-transmissive layer 66 may extend across the entire shutter 22 (e.g., the light-transmissive layer 66 may have a size and shape corresponding to the non-transparent region 54 and the shutter bump 56). The degree of transparency or translucency for the light-transmissive layer 66 is selected such that shutter bump 56 reduces or attenuates the amount of light that is allowed to pass through shutter bump 56, thereby reducing the luminosity of the specific point and/or area below the horizontal axis. Shutter bump 56 is configured to always allow at least some incident light from light source 20, but less than all incident light, to pass through shutter bump 56. As such, the light-transmissive layer 66 will never be opaque and will have a degree of transmissivity (either transparency or translucency) that is greater than 0% and less than 100%.

Examples of materials that the light-transmissive layer 66 may be made from include, but are not limited to, plastics (e.g., but not limited to, polymethyl methacrylate (PMMA), polycarbonate (PC), polymethacrylmethylimid (PMMI), optical silicone resins, cycloolefin copolymers, or the like) as well, as glass and/or ceramics, which may optionally include one or more agents to alter the degree of transparency or translucency. The light-transmissive layer 66 may include, but is not limited to, a masked layer, metallized layer, paint, and/or coatings. While only one light-transmissive layer 66 is shown, it should be appreciated that additional light-transmissive layers 66 may be provided. The additional light-transmissive layers 66 may be coextensive with the light-transmissive layer 66 shown and/or may extend across only a portion of the shutter 22 (e.g., but not limited to, all and/or a portion of the shutter bump 56).

The non-transparent layer(s) 68 may cover the entire non-transparent region 54 of the shutter 22. For example, one or more of the non-transparent layer(s) 68 may abut against a portion of the light-transmissive layer 66 in the area defined by the non-transparent region 54. Alternatively (or in addition), one or more of the non-transparent layer(s) 68 may be applied against one or more intermediate layers (not shown). The intermediate layers may be configured to enhance the bonding between the light-transmissive layer 66 and the non-transparent layer(s) 68. Examples of intermediate layers include, but are not limited to, precursor layers, seeding layers, and/or adhesive layers.

According to one embodiment, the non-transparent layer(s) 68 may be an opaque material configured to absorb light in the visible wavelength range. Alternatively (or in addition), the non-transparent layer(s) 68 may be an at least partially (e.g., fully) reflective material. In particular, the non-transparent layer(s) 68 may be configured to reflect all or a portion of the visible light back towards the reflector 28. As may be appreciated, the use of an at least partially reflective non-transparent layer(s) 68 may increase the overall luminosity of the projector apparatus 12 compared to an opaque non-transparent layer(s) 68. The non-transparent layer 68 can be formed by masking party of plastics layer 66 and then by metallization onto plastic layer 66, or by coating or painting. Non-transparent layer 68 is substantially opaque; an example of its being opaque is being 65% reflective, as discussed hereinabove.

Figure 10:
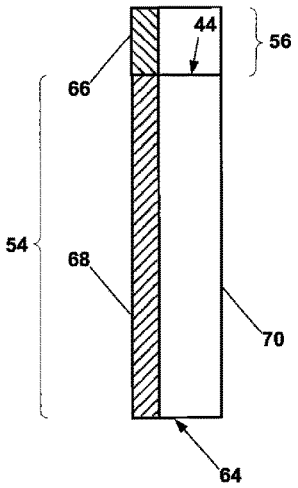
FIG. 10 is a cross-sectional view diagrammatically illustrating another embodiment of the shutter of FIG. 6 taken along lines B-B.

Turning now to FIG. 10, a cross-sectional view of another embodiment of the shutter 22 of FIG. 6 taken along lines B-B is generally illustrated. According to this embodiment, the shutter 22 may include at least one transparent layer 70, at least one light-transmissive layer 66, and at least one non-transparent layer 68. The transparent layer 70 may extend across the entire shutter 22 (e.g., the transparent layer 70 may have a size and shape corresponding to the non-transparent region 54 and the shutter bump 56). As such, the transparent layer 70 may define the overall size and shape of the shutter 22.

One or more of the light-transmissive layer 66 may cover the entire shutter bump 56. The degree of transparency or translucency for the light-transmissive layer 66 is selected such that the shutter bump 56 reduces or attenuates the amount of light that is allowed to pass through the shutter bump 56, thereby reducing the luminosity of the specific point and/or area below the horizontal axis as described herein. While only one light-transmissive layer 66 is shown, it should be appreciated that additional light-transmissive layers 66 may be provided. The additional light-transmissive layers 66 may be coextensive with the light-transmissive layer 66 shown and/or may extend across only a portion of the shutter 22 (e.g., but not limited to, all and/or a portion of the shutter bump 56). The non-transparent layer(s) 68 may cover the entire non-transparent region 54 of the shutter 22. The non-transparent layer(s) 68 may be an opaque material (i.e., configured to absorb light in the visible wavelength range) and/or an at least partially (e.g., fully) reflective material.

As may be appreciated, one or more of the light-transmissive layer 66 and/or non-transparent layer(s) 68 may abut against a portion of the transparent layer 70 in the area defined by the shutter bump 56 and non-transparent region 54, respectively. Alternatively (or in addition), one or more of the light-transmissive layer 66 and/or non-transparent layer(s) 68 may be applied against one or more intermediate layers (not shown). The intermediate layers may be configured to enhance the bonding between the light-transmissive layer 66 and/or light-transmissive layer 66 and the transparent layer(s) 70. Examples of intermediate layers include, but are not limited to, precursor layers, seeding layers, and/or adhesive layers.

Optical simulations of one embodiment of a projector apparatus 12 consistent with the present disclosure were performed. Projector apparatus 12 (including shutter 22 having a shutter bump 56) emitted light below the horizontal axis (e.g., horizontal axis 106 as illustrated in FIG. 5). The flux of the light in an area which corresponds to the (0.86D, 3.5L) test point 112 (FIG. 5) was reduced compared to the mirror image region on the right side of the central, vertical axis 114. Shutter bump 56 therefore can attenuate the flux in a specific point and/or area (i.e., reduce some of the light in the specific point and/or area while still allowing some light to pass therein) without negatively influencing the remaining light pattern (e.g., the remaining light pattern below the horizontal axis 106). Thus, shutter bump 56 can therefore allow the light pattern in the low beam mode to be non-symmetric about vertical axis 114. Also, in the illustrated embodiment, the area which is attenuated corresponds to an area having a central region defined by the NHTSA (0.86 D, 3.5L) test point 112 which has a maximum permitted light intensity of 12,000 candela, and according to the simulation, without use of shutter bump 56 the intensity at point 112 would have exceeded that regulatory threshold but with shutter bump 56 the intensity was within that maximum. Additionally, it should be appreciated that shutter bump 56 is not limited to the position and/or area shown, and that shutter bump 56 may attenuate the light at other points and/or areas, as well at a number of points and/or areas.

Additionally, optical simulations of one embodiment of the projector apparatus 12 consistent with the present disclosure were performed in an optional high beam mode in which light was emitted above and below the horizontal axis 106. The shutter 22 does not impact the light pattern. Instead, the light pattern is based on the primary light source 20, the reflector 28, and the projector lens 30 since the shutter 22 is pivoted out of the light beam.

While the primary light engines have been illustrated herein as a single light source, the primary light engine may include multiple light sources depending on the application. For example, the primary light engines may include any known light source configuration such as one or more incandescent light source (such as, but not limited to, a halogen lamp), LEDs (with or without a remote phosphor element), a gas discharge light source such as a fluorescent tube (e.g., in a CFL lamp), a HID light source, or any combination thereof.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, are understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted herewith. It is pointed out that this abstract is being provided to comply with the rule requiring an abstract that will allow examiners and other searchers to quickly ascertain the general subject matter of the technical disclosure. It is submitted with the understanding that it will not be used to interpret or limit the scope or meaning of the claims, as set forth in the rules of the U.S. Patent and Trademark Office.

The following, non-limiting list collects reference numerals used in the specification.

10 lighting system
12 projector apparatus
14 power source
16 controller
18 housing
20 primary light engine
22 shutter
24 heat management
27 ballast circuits
28 reflector
30 projector lens
32 reflector cup
34 opening/mounting surface
36 open end

38 interior surface
40 upper partial projector lens
42 lower partial projector lens
44 upper edge
45 portion of upper edge 44
48 actuator mechanism
50 portion
52 primary light engine facing surface
54 non-transparent region
56 shutter bump
62*a, b* lateral edges
64 bottom edge
66 light-transmissive layer
68 non-transparent layer
70 transparent layer
82 horizontal axis
84 specific point and/or area
86 mirror image region
100 standard United States beam distribution
101 low beam light spread
102 road right edge
103 road center line
104 road left edge
106 horizon axis/line
108 on-coming driver's eye position in a car of standard height
110 on-coming driver's eye position in a truck or SUV of taller height
112 (0.86D, 3.5L) test point
114 vertical axis/line
B1-B4 light beams
O1 optical axis
F1 focal point

What is claimed is:

1. An automotive vehicle projector headlamp (12) comprising:

a reflector (28) configured to reflect visible light emitted from a primary light engine (20);

a projector lens (30) configured to project at least a portion of said reflected visible light from said reflector (28); and a shutter (22) disposed at a first position between said primary light engine (20) and said projector lens (30), said shutter (22) comprising a non-transparent region (54) and an upper edge (44) defining a cut-off whereby said shutter (22) is configured to selectively obscure a portion of said projector lens (30) from said reflected visible light and to selectively emit at least a portion of said reflected visible light through at least a portion of said projector lens (30) in a first low-beam light distribution pattern when disposed in said first position, said shutter (22) further comprising a partially light-transmissive shutter bump (56) which attenuates an amount of visible light emitted from said projector lens (30) in a predefined area of said first light distribution pattern, said shutter bump (56) extending away from and above said upper edge (44) of said shutter (22).

2. The projection apparatus of claim 1, wherein the shutter bump (56) is disposed on said upper edge (44) and corresponds to a projected position on a beam test pattern at a location 0.86 degrees below horizon and 3.5 degrees left of a beam central vertical axis.

3. The projection apparatus of claim 1, wherein said light-transmissive shutter bump (56) has a transmittance not exceeding 50%.

4. The projection apparatus of claim 1, wherein said light-transmissive shutter bump (56) has a transmittance between about 30% and not exceeding 50%.

5. The projection apparatus of claim 1, wherein at least a portion of said upper edge (44) of said shutter (22) is substantially planar.

6. The projection apparatus of claim 1, wherein said primary light engine (20) comprises a solid-state light (SSL) source and wherein said shutter (22) is a plastics material.

7. The projection apparatus of claim 6, wherein said shutter (22) is polycarbonate.

8. The projection apparatus of claim 1, wherein said shutter bump (56) comprises a translucent material.

9. The projection apparatus of claim 1, wherein said non-transparent region (54) is opaque.

10. The projection apparatus of claim 1, wherein said non-transparent region (54) is at least partially reflective.

11. The projection apparatus of claim 1, wherein said shutter (22) comprises a translucent layer (66) and a non-transparent layer (68), wherein said non-transparent layer (68) covers only said non-transparent region (54).

12. The projection apparatus of claim 11, wherein said shutter (22) comprises a transparent layer (70), a non-transparent layer (68), and a translucent layer (66), wherein said non-transparent layer (68) is coupled to said transparent layer (70) and covers only said non-transparent region (54) and wherein said translucent layer (66) is coupled to said transparent layer (70) and covers only said shutter bump (56).

13. The projection apparatus of claim 1, wherein said shutter (22) is configured to be moveable from said first position to a second position, wherein said second position corresponds to a high-beam light distribution pattern.

14. The projection apparatus of claim 1, wherein said shutter (22) is fixed in said first position.

* * * * *